US006474110B1

(12) United States Patent
Kurschatke et al.

(10) Patent No.: US 6,474,110 B1
(45) Date of Patent: Nov. 5, 2002

(54) SPIRAL STEAMER

(75) Inventors: Wolfgang Kurschatke, Krefeld (DE); Walter Otten, Krefeld (DE); Dieter Russkamp, Mönchengladbach (DE); Walter Schumacher, Aachen (DE)

(73) Assignee: Eduard Kusters Maschinenfabrik GmbH & Co. KG, Krefeld (DE)

( * ) Notice: Subject to any disclaimer, the term of this patent is extended or adjusted under 35 U.S.C. 154(b) by 0 days.

(21) Appl. No.: 09/554,475

(22) PCT Filed: Aug. 16, 1998

(86) PCT No.: PCT/DE99/02259

§ 371 (c)(1),
(2), (4) Date: Aug. 9, 2000

(87) PCT Pub. No.: WO99/25913

PCT Pub. Date: May 27, 1999

(30) Foreign Application Priority Data

Nov. 14, 1997 (DE) ..... 197 50 573

(51) Int. Cl.[7] ..... D06B 3/12

(52) U.S. Cl. ..... 68/5 E

(58) Field of Search ..... 68/5 D, 5 E

(56) References Cited

FOREIGN PATENT DOCUMENTS

DE 1111139 * 7/1961 ..... 68/5 D

* cited by examiner

*Primary Examiner*—Philip Coe
(74) *Attorney, Agent, or Firm*—Kenyon & Kenyon

(57) ABSTRACT

In a spiral steamer, the deflecting rollers are arranged in the lower areas of the individual windings of the spiral in such a way that the fabric web approximately follows a chain line.

7 Claims, 1 Drawing Sheet

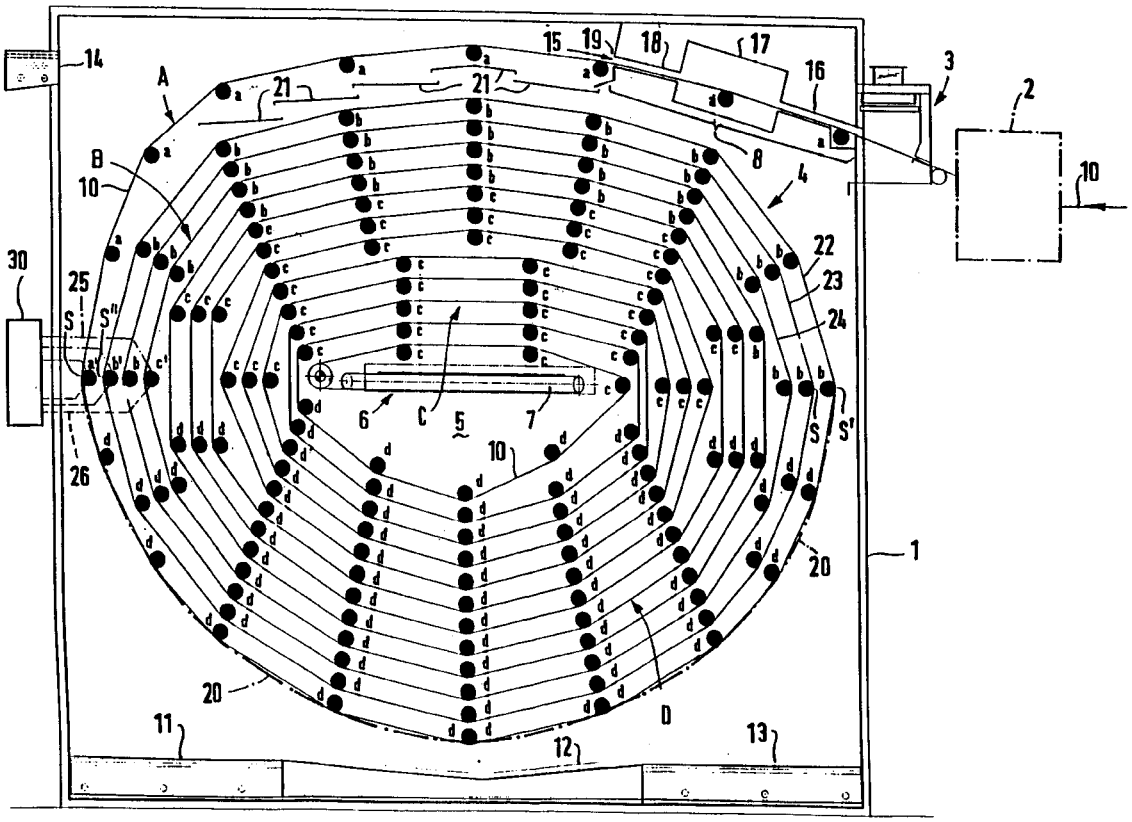
14
A
B
10
30
25
S
S''
26
21
21
15
19
18
17
16
3
2
10
8
4
22
23
24
6
C
5
7
10
S
S'
20
1
20
D
11
12
13

SPIRAL STEAMER

BACKGROUND OF THE INVENTION

The invention relates to a spiral steamer for fabric webs in which there is a housing that is sealed except for an intake and-an outlet, having means for producing and maintaining a steam atmosphere in the housing, deflecting rollers mounted to rotate in the housing, transversely to the fabric web, which are arranged in such a way that the fabric web can be guided around the outside of the deflecting rollers in a spiral that has several windings. The steamer also has a turning device arranged in the center of the spiral, by which the fabric web can be guided laterally out of the spiral, to the outlet.

Such spiral steamers are described, for example, in the book by Peter and Rouette, "Grundlagen der Textilveredlung" [Principles of Textile Finishing], 13th edition (1989), Deutsche Fachverlag GmbH Frankfurt am Main, on page 665, and illustrated in FIG. 7.288. The individual windings of the spiral, viewed in a vertical lengthwise plane of the fabric web, have approximately the shape of a horizontal ellipsis, whose longer axis runs approximately horizontally. The fabric web is passed around the deflecting rollers on the outside, in each instance. In the bottom segments, the fabric web is held against the deflecting rollers solely by its lengthwise tension. Sometimes, it hangs freely. In any case, however, in the known spiral steamers, the tension of the fabric web at the deflecting rollers located in the region of the apex at the ends of the horizontal axis of the elliptical spiral windings (these are the apices that are meant when the term "apex" is used hereinafter) is significantly greater than at the lowest point of the winding in question. The high tension in the region of the apices is undesirable, for one thing because many materials cannot tolerate it, because the treatment effect becomes non-uniform due to the bending of the deflecting rollers at that location, and because under some circumstances, particularly in the initial region, a squeezing effect can occur, causing parts of the metered bath applied to the fabric web to be removed from it.

The invention is based on the task of making the tension in the fabric web uniform in a spiral steamer of the type noted above.

SUMMARY OF THE INVENTION

In the present invention, the fabric web hangs down, in its bottom segment, between the apices of the spiral winding, and is held against the deflecting rollers only by its tension. The flatter the bottom segment runs, the greater are the contact forces at the deflecting rollers in the vicinity of the apices in relation to the contact surfaces in the region of the lowest point. If the fabric web between the deflecting rollers, in the region of the apices, is now compared with a hanging chain or a hanging rope, without the deflecting rollers it would run in a certain parabola-like curve that is referred to as a chain line or a catenary curve, and is independent of the weight of the chain or the rope per length unit.

If, as happens in the invention, the deflecting rollers are now arranged in such a way that the track of the fabric web in a vertical lengthwise plane of the web approximately corresponds to a chain line or catenary curve, no special tension in the fabric web is required in order to have it rest against all of the deflecting rollers, even in the bottom segment of the winding of the fabric web in each instance. This makes the lengthwise tension that is required in the web to achieve the desired contact force lower, in total, on the one hand, and more uniform, on the other hand.

To avoid the formation of condensate and dye deposits on the deflecting rollers, they are all driven. Until now, this drive was provided via chains. Since a spiral steamer can contain over a hundred deflecting rollers, the mechanical effort involved in providing the chain drive was significant.

According to another aspect of the invention, each deflecting roller has its own drive assigned to it, e.g. via an electric motor.

In other words, the drive torque is no longer mechanically passed on from a drive motor, common to several deflecting rollers, to additional deflecting rollers.

With this provision of a suitable control system, what is achieved is that the tension of the fabric web is checked at several locations and regulated in suitable manner. The tension of the fabric web is expressed as a specific force exerted by the fabric web on a deflecting roller, which force can be measured by a suitable transducer. One of the drives of the deflecting rollers of a group is the master drive, regulated on the basis of the measurement taken at a deflecting roller of this group, and the other drives follow it. The deflecting roller with the master drive and the deflecting roller with the measurement can be the same deflecting roller, but do not have to be.

In this manner, a uniform and relatively low lengthwise tension can be maintained in the entire fabric content of the spiral steamer.

A further measure to maintain a low fabric web tension, which is actually known, is drive of the deflecting rollers with peripheral precession.

In steamers, steam constantly exits at the intake of the fabric web, resulting in a significant loss of energy and corresponding costs.

A further aspect of this invention is a channel to serve to reduce the steam losses. This channel, with its changes in cross-section in the region of the incoming fabric web, acts similar to a labyrinth seal, and inhibits the outflow of steam along the fabric web at the intake.

It is true that this structure is particularly practical for the spiral steamer according to the present invention, which has large dimensions when the fabric content is large, but it can also be used for other types of steamers.

BRIEF DESCRIPTION OF THE DRAWING

The drawing shows an exemplary embodiment of the invention. It shows a vertical cross-section through a spiral steamer.

DETAILED DESCRIPTION

The spiral steamer, designated as a whole as 100, includes a housing 1 in the shape of a box that can have very large dimensions, depending on the fabric content. For a fabric content of 200 meters, housing 1 can have a height from 8 to 10 meters. Fabric web 10 is made up of a so-called three-dimensional textile planar structure, for example a pile textile such as imitation fur, velvet, a decorative fabric with a pile, woven carpeting, and the like. What these textiles have in common is that they are allowed to come into contact with deflecting rollers only on the back of the material.

Fabric web 10 first passes through a bath application device 2, which is indicated in the drawing only as a box, with a dot-dash line, and can be a device for pouring on the bath, a foulard, or the like.

Fabric web 10, coming from bath application device 2, passes through intake 3 of housing 1, which is arranged in the top region of a vertical wall of the housing.

Inside housing 1, the fabric web is guided over deflecting rollers a, b, c, d, which are arranged in such a way that fabric web 10 always runs around the outside of deflecting roller a, b, c, d, in each instance, and runs through a spiral-shaped course, in total, where individual windings 22, 23, 24, . . . of spiral 4 become narrower and narrower from the outside to the inside, until the fabric web has arrived in center 5 of spiral 4, where it runs over a turning device 6 in the form of a so-called rolling sword 6, with a roller 7 arranged in a horizontal plane, at an angle of 45° to the crosswise direction of fabric web 10, which guides fabric web 10 laterally out of the spiral plane, so that it can be passed out of housing 1 from the plane of the drawing, in a corresponding outlet, not shown.

In the exemplary embodiment, the deflecting rollers are divided into four groups A, B, C, D with the related individual deflecting rollers a', b', c' each being identified with the lower-case letters a, b, c, d written next to them. Each individual deflecting roller a, b, c, d is driven by its own electric motor. At one deflecting roller A, B, C, D of groups A, B, C, marked with a line, a measurement of the tension of the fabric web prevailing there takes place, via a measurement of the force exerted by fabric web 10 on deflecting roller a' or b' or c' in question. The measurement signal is passed to a regulation device via lines 25. The speed of deflecting roller a', b', c' in question is controlled on the basis of the force measurement, as is supposed to be indicated by lines 26. The corresponding drive is the master drive. The other drives of the group in question are slave drives, i.e. they automatically follow the speed changes of the master drive. Deflecting rollers a, b, c, d run at a certain peripheral precession, so that fabric web 10 is held taught all over, with little tension.

Three steam generators 11, 12, 13 are provided at the bottom of housing 1, with one steam generator 14 being assigned to them in the top region of the wall of housing 1 that lies opposite intake 3. In this manner, the interior of housing 1 can be kept uniformly filled with steam.

Incoming segment 8 of fabric web 10 is surrounded by a channel, indicated as a whole as 15, which channel is closed in a crosswise plane transversely to fabric web 10, and has a first segment 16, following intake 3, through which fabric web 10 just fits, in other words which is small in height. In subsequent region 17, the cross-section is wider, i.e. there the channel has six times the height as in region 16. Subsequent to region 17, there is another segment 18 of channel 15 that again is small in height. At location 19, channel 15 opens freely into the interior of the housing. The configuration arranged in housing 1, of a channel with alternating widened and narrowed cross-section, acts like a labyrinth seal and inhibits steam from flowing out of intake 3, so that the energy losses at this location, which is necessarily open, are reduced.

In the region following channel 15, drip plates 21 are arranged below fabric web 10, which are supposed to prevent bath and/or condensate drops from dripping off fabric web 10, which has not yet set in this region, and is highly charged with bath (e.g. 200% of the weight of the fabric), onto winding 22 of spiral 4, which is below them.

It is true that each individual winding 22, 23, 24, . . . is a polygon progression, with the deflecting roller in each instance being arranged in the corners of the polygon. By approximation, however, each individual winding 22, 23, 24, . . . has the shape of an oval or a horizontal ellipsis, whose apices lie in a horizontal plane and are indicated in the drawing with S and SI for outermost winding 22.

In the spiral steamers of the state of the art, the individual windings of the spiral are essentially shaped symmetrical to the horizontal plane that passes through the apices S, S', which has the result that the bottom segments of the windings were relatively flat and that significant tension had to be exerted on fabric web 10 in the region of apices S, S', in order to maintain contact with deflecting roller d in the region of lowest point T.

In spiral steamer 100 shown in the drawing, however, fabric web 10 runs in accordance with a chain line 20, indicated in the drawing with a dot-dash line, due to the corresponding arrangement of the deflecting rollers in the bottom segment of each winding. Such a chain line is formed if a chain or a loose rope is allowed to hang freely from two suspension points, which are assumed to be in the region of apices S, S' for outer winding 22 of spiral 4. For winding 23, which is located farther in, the suspension points would be assumed to be in the region S", S'", of this winding. Thus each winding has its own "chain line" assigned to it, where the length of the "chain" is predetermined by the location of the lowest point of the winding in question, which is predetermined by the design.

The result is that fabric web 10 is guided around the deflecting rollers in the bottom segment of the individual windings in accordance with a progression that it would have on its own, even without the deflecting rollers. In this way, fabric web 10 rests against the deflecting rollers there with a uniform, low force.

What is claimed is:

1. A spiral steamer for fabric webs, comprising:

a housing that is sealed except for an intake and an outlet;

means for producing and maintaining a steam atmosphere in the housing;

deflecting rollers mounted to rotate in the housing, transversely to the fabric web, the deflecting rollers being arranged in such a way that the fabric web can be guided around the outside of the deflecting rollers in a spiral that has several windings; and a turning device arranged in the center of the spiral, by which the fabric web can be guided laterally out of the spiral, to the outlet, wherein the contact locations of the fabric web on the deflecting rollers for the bottom segments of a winding of the spiral, in each instance, lie at least approximately on chain lines having suspension points in the region of the apices of the winding in question.

2. The spiral steamer according to claim 1, wherein each of the deflecting rollers is separately and independently driven.

3. The spiral steamer according to claim 2, wherein the deflecting rollers are driven with a circumferential velocity that is slightly greater than a velocity of the fabric web.

4. The spiral steamer according to claim 1, wherein the deflecting rollers are driven with a circumferential velocity that is slightly greater than a velocity of the fabric web.

5. The spiral steamer according to claim 1, further comprising a channel, which is closed in a crosswise plane transversely to the fabric web and surrounds the fabric web in an intake segment, and proceeds from the intake at one end, and opens into the interior of the housing at the other end, and has consecutive widenings in cross-section and narrowings in cross-section.

6. A spiral steamer for fabric webs, comprising:

a housing that is sealed except for an intake and an outlet;

means for producing and maintaining a steam atmosphere in the housing;

deflecting rollers mounted to rotate in the housing, transversely to the fabric web, the deflecting rollers being arranged in such a way that the fabric web can be guided around the outside of the deflecting rollers in a spiral that has several windings; and a turning device arranged in the center of the spiral, by which the fabric web can be guided laterally out of the spiral, to the outlet, wherein the contact locations of the fabric web on the deflecting rollers for the bottom segments of a winding of the spiral, in each instance, lie at least approximately on chain lines having suspension points in the region of the apices of the winding in question, and wherein all the deflecting rollers have their own drive assigned to them, and wherein the deflecting rollers are divided into several groups and at least one of these groups has a master drive that is regulated via a force measurement at one of the deflecting rollers, while the other deflecting rollers of the group in question are slave drives.

7. The spiral steamer according to claim 6, wherein the deflecting rollers are driven with a circumferential velocity that is slightly greater than a velocity of the fabric web.

* * * * *

UNITED STATES PATENT AND TRADEMARK OFFICE

CERTIFICATE OF CORRECTION

PATENT NO. : 6,474,110 B1
DATED : November 5, 2002
INVENTOR(S) : Kurschatke et al.

It is certified that error appears in the above-identified patent and that said Letters Patent is hereby corrected as shown below:

Column 3,
Line 67, change “Sl” to -- S‘ --; and

Column 4,
Line 18, change “S’‘, S’‘’, “ to -- “S’‘, S’‘’ --.

Signed and Sealed this

Twenty-second Day of June, 2004

JON W. DUDAS
*Acting Director of the United States Patent and Trademark Office*